US010629356B2

(12) United States Patent
Findeisen

(10) Patent No.: US 10,629,356 B2
(45) Date of Patent: Apr. 21, 2020

(54) TRANSFORMER WITH TEMPERATURE-DEPENDENT COOLING FUNCTION

(71) Applicant: SIEMENS AKTIENGESELLSCHAFT, Munich (DE)

(72) Inventor: Joerg Findeisen, Dresden (DE)

(73) Assignee: Siemens Aktiengesellschaft, Munich (DE)

( * ) Notice: Subject to any disclaimer, the term of this patent is extended or adjusted under 35 U.S.C. 154(b) by 23 days.

(21) Appl. No.: 16/071,569

(22) PCT Filed: Jan. 18, 2017

(86) PCT No.: PCT/EP2017/050933
§ 371 (c)(1),
(2) Date: Jul. 20, 2018

(87) PCT Pub. No.: WO2017/125407
PCT Pub. Date: Jul. 27, 2017

(65) Prior Publication Data

US 2019/0027292 A1 Jan. 24, 2019

(30) Foreign Application Priority Data

Jan. 20, 2016 (DE) ..... 10 2016 200 744

(51) Int. Cl.
*H01F 27/12* (2006.01)
*H01F 27/02* (2006.01)
(Continued)

(52) U.S. Cl.
CPC ..... *H01F 27/12* (2013.01); *H01F 27/025* (2013.01); *H01F 27/08* (2013.01); *F28F 2250/104* (2013.01); *H01F 27/14* (2013.01)

(58) Field of Classification Search
CPC ..... H01F 27/12; H01F 27/14; H01F 27/125; H01F 27/025; H01F 27/08; F28F 1/22;
(Continued)

(56) References Cited

U.S. PATENT DOCUMENTS 1,476,172 A * 12/1923 Nichols ..... H01F 27/14 165/104.33
1,526,771 A * 2/1925 Burnham ..... H01F 27/025 165/104.33
(Continued)

FOREIGN PATENT DOCUMENTS

DE M 4820 12/1955
DE 1142000 A 1/1963
(Continued)

*Primary Examiner* — Jon T. Schermerhorn, Jr.
(74) *Attorney, Agent, or Firm* — Laurence Greenberg; Werner Stemer; Ralph Locher

(57) ABSTRACT

An electric device has a housing and an active part in the housing that can be supplied with a high voltage and that generates heat when operated. The housing is filled with an insulating liquid for cooling. A cooling system for cooling the insulating liquid has at least one cooling element which is connected to the external atmosphere in a heat-conductive manner and via which the insulating liquid is conducted. Temperature fluctuations of the electric device are limited or even prevented in an inexpensive manner. The cooling system has a rising section which is connected to the housing, is provided with rising branches, and is connected to a cooling element at each rising branch. The volume of the rising section is selected on the basis of a thermal expansion coefficient of the insulating liquid such that the fill state reaches a different number of rising branches at specific temperatures.

15 Claims, 6 Drawing Sheets

(51) Int. Cl.
*H01F 27/08* (2006.01)
*H01F 27/14* (2006.01)

(58) Field of Classification Search
CPC ..... F28F 2250/104; F28F 2265/24; F28F 2265/14
See application file for complete search history.

(56) References Cited

U.S. PATENT DOCUMENTS 1,609,177 A * 11/1926 Lessells ..... H01F 27/025 165/104.33
1,693,324 A * 11/1928 Stephens ..... H01F 27/12 165/104.33
1,725,623 A * 8/1929 Dickenson ..... H01F 27/14 174/11 R
1,793,820 A * 2/1931 Nichols ..... H01F 27/14 174/12 R
1,887,569 A * 11/1932 St Palley ..... H01F 27/002 165/47
5,252,778 A * 10/1993 Ogawa ..... H01F 27/20 165/104.33
5,461,873 A 10/1995 Longsworth
7,443,273 B2 10/2008 Findeisen
2001/0032718 A1 10/2001 Sheerin et al.
2018/0269682 A1* 9/2018 Specht ..... H05K 7/20236

FOREIGN PATENT DOCUMENTS

DE 1913163 A1 10/1969
DE 1613759 C3 3/1974
DE M4820MAZ 12/1995
EP 2290663 B1 1/2017
GB 1239342 A 7/1971
GB 2342713 A 4/2000
RU 2002122748 A 3/2004
SU 1517070 A 10/1989
WO 9508743 A1 3/1995
WO 2005124799 A2 12/2005

* cited by examiner

TRANSFORMER WITH TEMPERATURE-DEPENDENT COOLING FUNCTION

BACKGROUND OF THE INVENTION

Field of the Invention

The invention relates to an electrical device comprising a housing, an active part which is arranged in the housing and to which high voltage can be applied and which generates heat when operated, an insulating liquid which is provided for cooling and with which the housing is filled, and a cooling system for cooling the insulating liquid, which cooling system has at least one cooling element which is thermally conductively connected to the external atmosphere and by means of which the insulating liquid is carried.

An electrical device of this kind is already known from established practice. For example, oil-filled transformers according to the prior art are equipped with radiators for cooling purposes. Said radiators are directly connected to the housing of the transformer, so that the insulating liquid flows through the radiator from the inside. By way of their outer side, the radiators face the atmosphere. A plurality of radiators which are arranged parallel in relation to one another and form so-called radiator batteries are provided in the case of large cooling systems in particular. During operation of the transformer, considerable changes in the quantity of heat given off by the active part, and consequently considerable changes in the temperature of the insulating liquid, occur on account of fluctuations in load. An oil expansion tank which is connected to the housing of the transformer is usually provided for the purpose of absorbing the change in volume of the insulating liquid which is caused by these fluctuations in temperature. Large fluctuations in temperature can lead to large changes in volume depending on the coefficient of thermal expansion of the insulating liquid, and therefore large expansion tanks are required in order to reliably absorb the large volumes of insulating liquid, which are produced at high temperatures, in the transformer.

Fluctuations in pressure which are dependent on the temperature of the insulating fluid and which likewise have a disadvantageous effect on the operation of the electrical device occur in the case of hermetically sealed transformers. In the case of a dehumidifying device which is connected to the housing of a breathing transformer, the throughput of air should be limited since, otherwise, the consumption of dehumidifying means increases.

SUMMARY OF THE INVENTION

The object of the invention is therefore to create a transformer of the kind mentioned in the introductory part in which fluctuations in temperature are limited or even avoided in a cost-effective manner.

The invention achieves this object in that the cooling system has a rising section which is connected to the housing and which is provided with rising branches and which is connected to a cooling element at each rising branch, wherein the volume of the rising section is selected depending on a coefficient of thermal expansion of the insulating liquid such that the filling level reaches a different number of rising branches at prespecified temperatures.

The present invention provides an electrical device, for example a transformer or an inductor, which is equipped with a passive temperature-dependent cooling system. In other words, the effective cooling surface of the cooling system is increased given an increasing cooling requirement, that is to say given an increasing temperature of the insulating liquid. To this end, the cooling system is equipped with a rising section, for example a rising pipe or a rising chamber, which is provided with rising branches. Each rising branch is connected to the input of a cooling element, so that heated insulating liquid which rises upward can flow from the rising section into the cooling element which is connected to the rising branch. The volume of the insulating liquid is selected such that, in the event of changes in temperature in the temperature range already known, the level of the insulating liquid, that is to say its surface or the filling level, in the rising section changes. Each rising branch is expediently connected to the upper input of the cooling element, that is to say the input which is averted from the base region of the electrical device, wherein the output of the cooling element is arranged further below, that is to say at a shorter distance from the base region of the electrical device. The output of the cooling element is again expediently connected to the housing by means of a pipeline, so that the cooling liquid can be carried by means of the respective cooling element, that is to say circulated in other words. In principle, the configuration of the respective cooling element is arbitrary within the scope of the invention. The volume of the insulating liquid is selected such that the filling level, that is to say the level of the insulating liquid, within the rising section is determined by the temperature of the insulating liquid. For example, at a predetermined temperature T1, a filling level or a level of the insulating fluid is reached at which the insulating fluid flows via the rising branch which is reached by it into the cooling element which is associated with said rising branch. Here, the flow is caused by convection in the sense that heated cooling liquid flows upward.

The vertical distance of the rising branches and the volume of the rising section, which is determined by its diameter, are selected or dimensioned depending on the coefficients of thermal expansion of the insulating liquid. This means that, at a prespecified second temperature T1 which lies, for example, just below a critical value, the insulating liquid level reaches the second rising branch and therefore the insulating liquid is carried by means of two cooling elements, wherein the surface of the entire cooling system is increased in size. Cooling which is increased in steps is therefore established. It goes without saying that it is possible within the scope of the invention to equip the rising section with two, three, four or more rising branches, depending on how finely the cooling is intended to be set. Cost-effective, reliable and highly effective temperature-dependent cooling is provided in this way.

Furthermore, the cooling system also acts as an expansion tank, so that the expansion tank which is otherwise usually provided can either be entirely dispensed with or else can be configured to be more compact.

Within the scope of the invention, the housing of the electrical device and the cooling system are filled with so much insulating liquid that, at all temperatures in the temperature range already known, the housing is filled with the insulating liquid up to the bottom edge of a cover which closes the housing at the top.

In particular, the invention also has an advantageous effect on the cold-starting behavior of a transformer. If the transformer according to the invention is out of operation, for example after a relatively long period of servicing, and is then recommissioned or is, for example, newly set up, cooling is poor owing to the lack of a high filling level of insulating liquid. The insulating liquid can heat up more rapidly and therefore achieves its desired properties more rapidly. The favorable cold-starting behavior of the transformer is advantageous particularly when using liquid esters as insulating liquid and constitutes a significant motivation of the invention.

By way of example, a plurality of rising sections are also possible within the scope of the invention. The geometric configuration of the rising section or rising sections is, in principle, arbitrary within the scope of the invention. However, it is preferred that each rising section is in the form of a rising pipe.

The or each rising section advantageously has an inclined section which runs in an inclined manner in relation to a side wall of the housing, wherein the rising branches are arranged in the inclined section. Within the scope of the invention, the term "inclined" means that the element in question does not run in either a vertical or a horizontal manner, but rather in an inclined manner. In other words, the inclined section spans an angle $\alpha$ with a horizontal. The rising branches are arranged in the inclined section. As the temperature increases, the insulating liquid in the inclined section rises, so that the insulating liquid flows through one, two or more cooling elements depending on the matching of the volume of the rising pipe or rising section to the inclined position and the coefficient of thermal expansion. According to a preferred further development in this respect, the cooling elements are also arranged at different heights, that is to say the height thereof is staggered in other words.

The insulating liquid is expediently an oil, an ester or another known insulating liquid with which the required dielectric strength between the active part, which is at high voltage, and the housing, which is usually connected to ground potential, is possible. Esters under consideration here are esters which are present in liquid form at the specified operating temperature. Esters of this kind are also called ester fluids.

Each rising branch is expediently connected to a radiator which has a plurality of inner cooling channels. Radiators are known to a person skilled in the art, and therefore a detailed explanation and description can be dispensed with here. The important factor here is that the radiator has a plurality of inner cooling channels which are all connected to an upper inlet of the radiator. At the lower end of the radiator, the cooling channels open into a lower manifold channel which is connected to the housing of the transformer by means of the output of the radiator and a corresponding pipeline. The addition of a further radiator by a corresponding rise in the insulating liquid in the rising section considerably increases the surface of the cooling system. In other words, the so-called step height of the cooling according to this refinement is comparatively large.

In a departure from this, each rising branch is connected to a separate individual cooling pipe in each case. In comparison to the one radiator, the cooling pipe has a significantly smaller cooling surface, so that, according to this version, correspondingly finer cooling is provided.

According to a further expedient refinement of the invention, the rising section has a vertical pipe section. Said vertical pipe section extends the housing in the direction of a side which is averted from a base wall, that is to say upward, wherein the rising branches are arranged in the vertical pipe section.

According to a further development of the invention which is expedient in this respect, each rising branch is connected to an input of a tubular pipe cooling means which, at its output, is connected to the housing in its base region. The use of a vertical rising pipe allows for a more compact configuration of the electrical device according to the invention.

Expediently, at least one rising branch is connected to an input of a pipeline which leads to a heat exchanger, wherein the heat exchanger, at the output end, is connected to the housing in the base region. According to this advantageous further development, the heated insulating liquid is additionally carried by means of a heat exchanger at a specific temperature, so that the thermal energy can be supplied for a further use. The rising branch is expediently already connected to a heat exchanger.

According to a further refinement of the invention, at least one rising branch is connected to a heat pipe. Heat pipes are known as such to a person skilled in the art, and therefore details relating to the configuration thereof can be dispensed with. Heat pipes are effective cooling means and are usually thermally conductively connected by way of a first end to the object to be cooled. On account of the heating, a liquid is evaporated in the interior of the heat pipe at this end. The endothermic evaporation ensures the desired cooling. The steam then rises to a cooler location and condenses there. The condensed liquid is returned to the lower end, for example, by means of capillary effects.

Furthermore, it may be expedient within the scope of the invention that a fan for intensifying the cooling effect of the cooling system is provided. The fan can interact, for example, with a heat exchange register to the effect that an air flow which is generated by the fan is carried past the outer surface of the cooling elements or of the radiator, wherein heat is absorbed by the air which is flowing past and said heat is carried away in this manner.

According to a further development which is expedient in this respect, the fan is connected to a regulating device which, for its part, is connected to a filling level sensor. The filling level sensor provides, at the output end, signals which correspond to a filling level in the rising section. The regulating device controls the fan in accordance with these filling level signals, so that, at high critical temperatures, the rotation speed of the fan is increased and therefore a stronger, more rapid air flow is generated. This intensifies the cooling effect of the fan. The fan can, of course, also be simply switched on or switched off in this way.

In an advantageous refinement of the invention, the housing, the cooling elements and also the rising pipe form a pressure-resistant, hermetically sealed unit, wherein the space above the filling level of the insulating liquid is filled with a compressible inert gas. The compressible inert gas, for example nitrogen, then acts as a gas cushion. If the temperature and therefore the filling level of the insulating liquid in the cooling system and the rising pipe rise, the inert gas in the part of the cooling system which remains above the insulating liquid is compressed. If required, additional containers which are filled with the inert gas are connected to the gas-carrying part of the cooling system or of the rising pipe by means of a pipeline. This creates hermetic sealing of the transformer, and the insulating liquid is reliably protected against influences of the ambient air.

The cooling function can be exactly controlled by suitably designing the cross section of the rising pipe, the vertical offset between the rising branches and also the number of cooling elements which are associated with each rising branch. The gradient of the load/temperature curve can be set in a targeted manner. The temperature gradient can be controlled as a linear, as an exponential, but also as a logarithmic function since, given a design of the electrical device according to the invention, a specific cooling area can be associated with each temperature. To this end, a specific number of cooling elements is associated with each rising branch in the rising tube depending on the desired profile of the cooling curve.

The selection depends on the respective requirements: cold-starting behavior, use at arctic temperatures, viscosity of the insulating liquid (ester), pressure equalization in the case of a hermetically sealed design, winding losses. In order to reduce the exchange of air in the case of breathing transformers and also in order to limit the fluctuations in pressure in the case of hermetically sealed transformers, a logarithmic profile of the temperature gradient by an over proportional increase in the incorporated cooling elements can be advantageous. That is to say, the assignment of the number of cooling elements for each rising branch increases as the height of the arrangement of the rising branch in the rising pipe increases.

Rapid incorporation of the entire cooling system when the optimum operating temperature is reached is suitable for maintaining low winding losses.

The rising section is advantageously provided with an opening above a maximum filling level of the insulating liquid, gas exchange with the surrounding area or further vessels being possible through said opening in the event of changes in volume which are caused by changes in the temperature of said insulating liquid, and the interior of the cooling elements entirely or partially absorbs the fluctuations in the volume of the insulating liquid.

It is also possible to ensure a minimum operating temperature, for example, with only a few or only one rising pipe branch, the entire cooling system then being connected to said rising pipe branch.

The electrical device is advantageously a transformer or an inductor.

Further expedient refinements and advantages of the invention are the subject matter of the following description of exemplary embodiments of the invention with reference to the figures of the drawing, wherein identical reference symbols refer to components which act in the same way, and wherein

DESCRIPTION OF THE INVENTION

Figure 1:
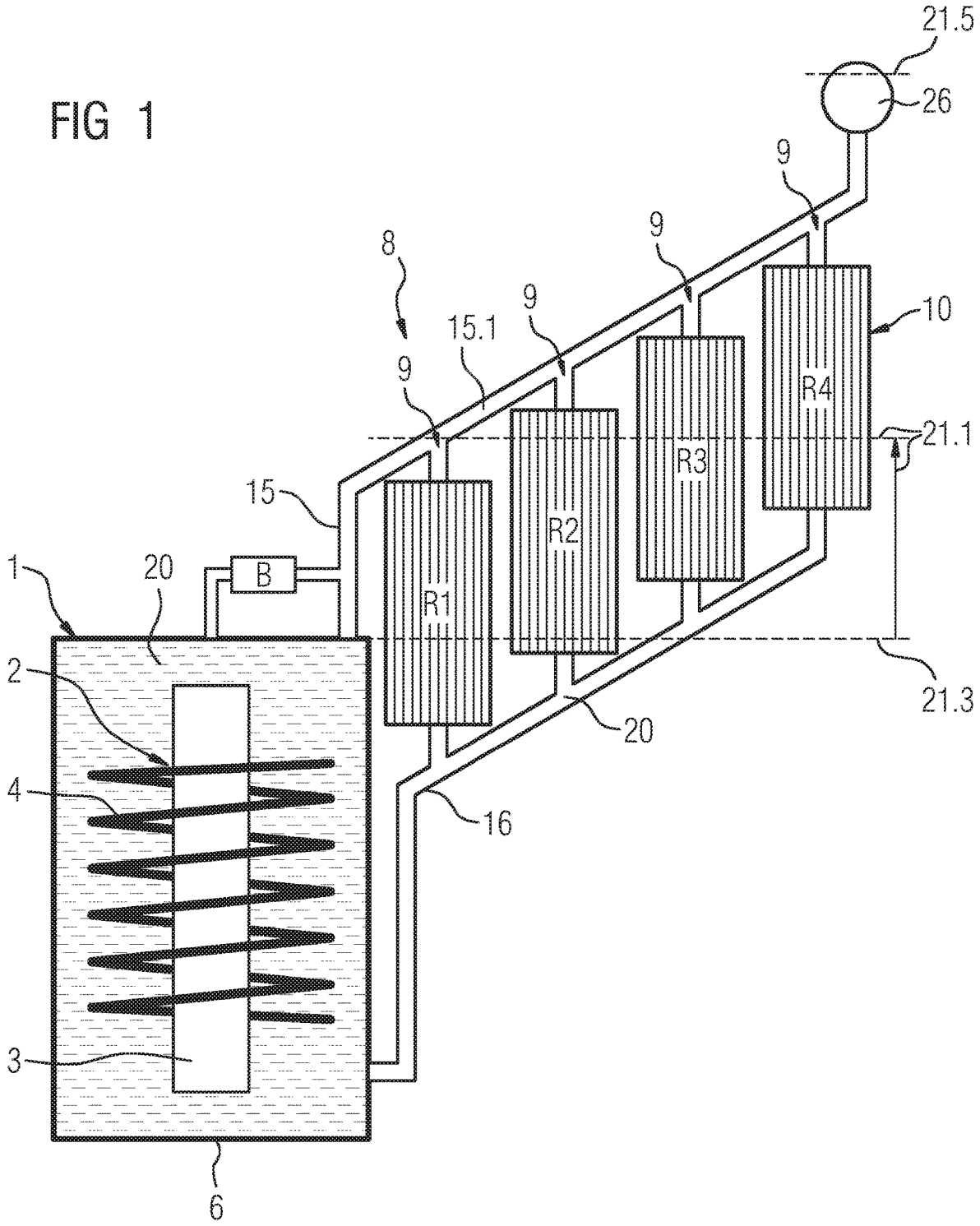
FIGS. 1 to 6 each show a schematic illustration of an exemplary embodiment of the electrical device according to the invention.

FIG. 1 shows a first exemplary embodiment of the device according to the invention which is a transformer 1 here. The transformer 1 has an active part 2 which, for its part, comprises a winding arrangement 4 which is wound around a magnetic core 3. The winding arrangement 4 comprises a low- and high-voltage winding, not illustrated further in the figures. Furthermore, the transformer 1 has a housing 6 which is filled with an insulating liquid 20. An oil expansion tank 26 which is connected to the housing 6 of the transformer 1 by means of a pipeline 15 is provided for accommodating insulating liquid at high temperatures. A cooling system 8 is arranged between the oil expansion tank 26 and the housing 6. The cooling system 8 has a rising pipe 15 as a rising section which has an inclined section 15.1. A return pipe 16 is further provided. The inclined section 15.1 of the pipeline 15 contains rising branches 9 which are connected to the upper input of radiators 10. Each radiator 10 is, for its part, equipped with a plurality of cooling channels which run parallel in relation to one another and which are connected to the return pipe 16 by means of an output. In FIG. 1, filling levels of the insulating liquid are further indicated by dashed lines. The filling level 21.3 corresponds to the minimum filling level of the insulating liquid which is established when the transformer 1 is not in operation. A filling level which is provided with reference numeral 21.1 is established during normal operation. The filling level 21.5 corresponds to a maximum filling level.

On account of the partially inclined profile of the pipeline 15, the radiators or, in other words, cooling elements 10 are arranged in a staggered manner in respect of height. This staggering in respect of height has an advantageous effect on the circulation rate of the insulating liquid 20 through the cooling system 8. The radiators are further hydraulically connected to the transformer 1 by the return line 16. An increasing temperature results in a rising filling level in the radiators 10 and also the pipeline 15 and, in particular, in the inclined section 15.1 owing to the expansion of the insulating liquid 20. The radiators 10 can come into effect only when the insulating liquid passes through said radiators or circulates in said radiators. To this end, the insulating liquid level in the inclined section 15.1 has to reach the rising branch 9 which is respectively associated with the radiator 10. The arrangement of the cooling elements 10 is selected in such a way that, depending on the desired cooling rate, a number of radiators which corresponds to the filling level of the insulating liquid is incorporated in the flow of the insulating liquid 20. Since, according to the invention, the cooling system 8 takes on the task of absorbing the thermally induced fluctuations in the volume of the insulating liquid, the expansion tank 26 can be configured to be more compact and, in an exemplary embodiment which differs from this, can be entirely dispensed with.

Figure 2:
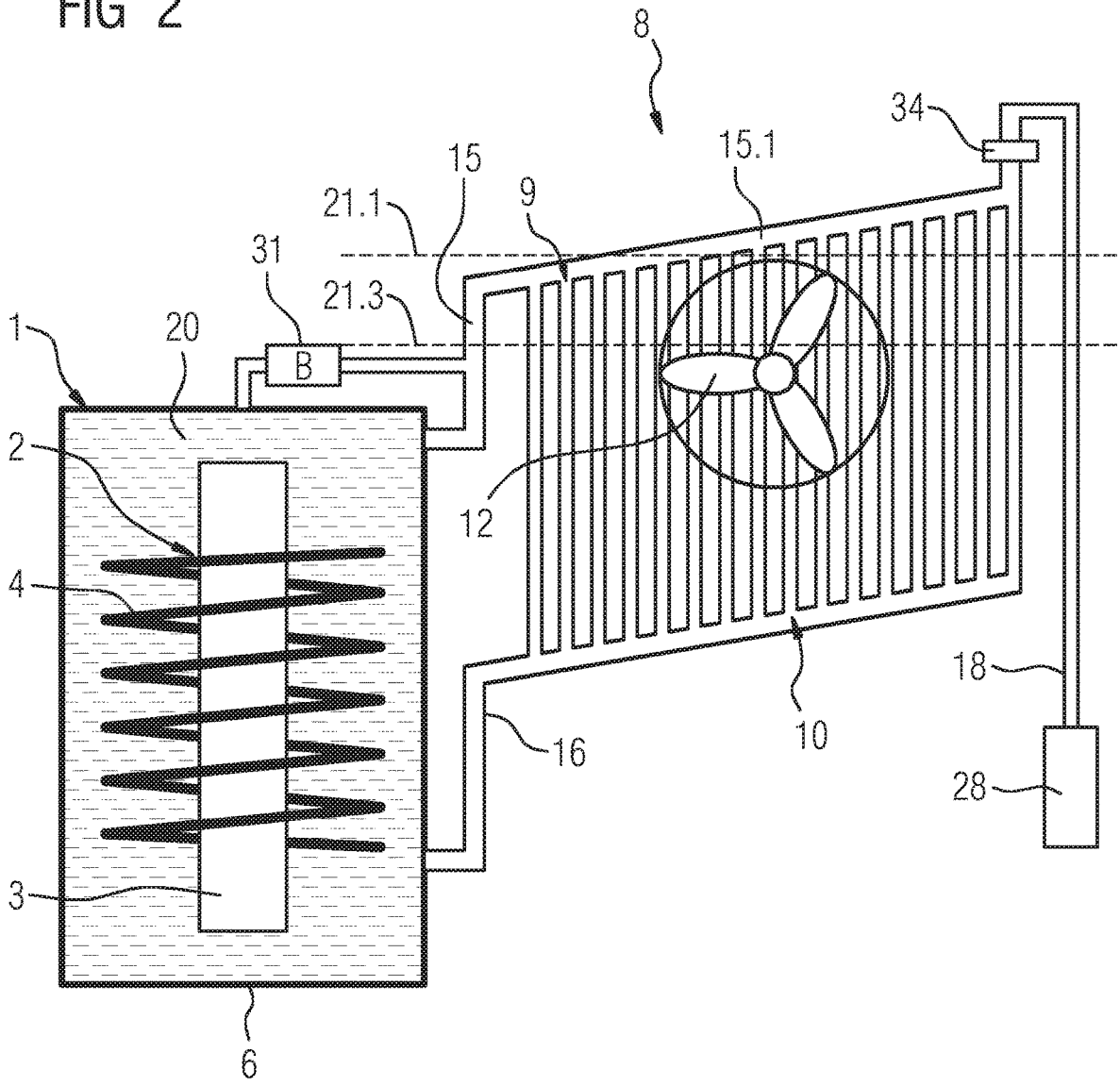

FIG. 2 shows an exemplary embodiment, which differs from FIG. 1, of the electrical device 1 according to the invention which is likewise in the form of a transformer 1 here. According to this exemplary embodiment, the housing 6 and the cooling system 8 are dimensioned such that the bottom edge of the cover of the transformer is arranged below the surface of the insulating liquid 20 at all temperatures of the insulating liquid 20. Therefore, the lower parts of a high-voltage bushing, not illustrated in the figures, are always completely surrounded by the insulating liquid 20. The pipeline 15 also has an inclined section 15.1 according to the exemplary embodiment illustrated in FIG. 2. However, the rising branches 3 of the inclined section 15.1 are each connected to the input of a separate cooling pipe 10. The cooling pipes 10 likewise act as cooling elements and, depending on the filling level of the insulating liquid 20, can be incorporated in the circulation of the insulating liquid 20, so that the cooling power increases to such an extent that an equilibrium is established between the supplied lost heat of the transformer 1 and the heat of the cooling system 8 which has been given off. If the filling level is so high that virtually all of the cooling pipes 10 are incorporated in the cooling operation, this is detected by a sensor 34 which is arranged in a tubular projection which protrudes in a perpendicular manner from the pipeline 15. The output signal of the sensor 34 is transferred to a regulating device, not shown in the figures, which then switches on a fan 12 which provides additional cooling. The actuation of the fan 12 is therefore combined with the hydraulic cooling.

In the exemplary embodiment shown in FIG. 2, the upper manifold pipe of the cooling system 8, that is to say the pipeline 15, is provided with a venting line 18. As the insulating liquid level rises, air is displaced out of the cooling system 8 and carried away by means of the venting means 18 and to a dehumidifying device 28 which is arranged at the outer end of the venting line 18 in order to avoid humidification of the insulating liquid when the system cools down and the filling level of the insulating liquid consequently drops.

Figure 3:
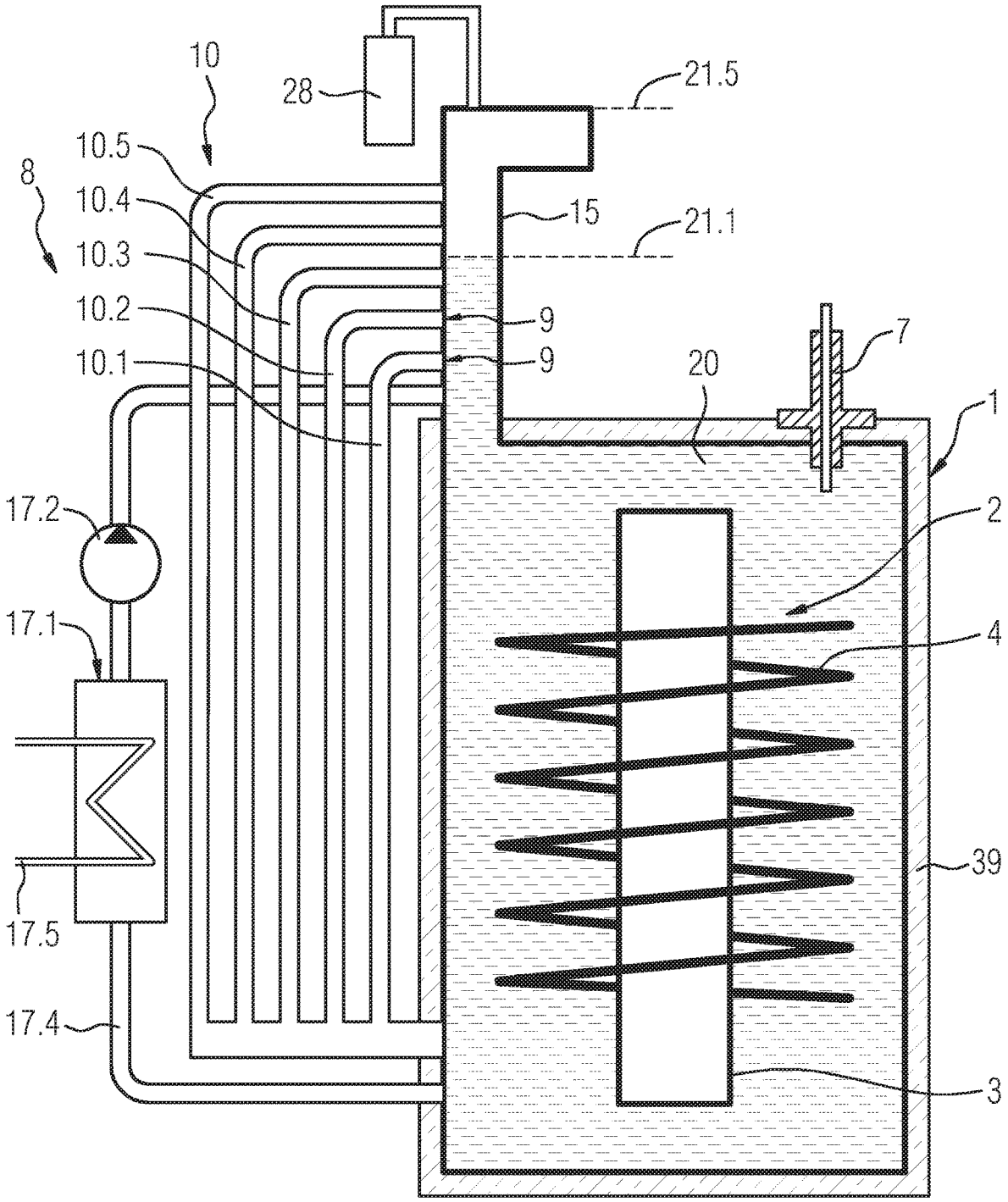

FIG. 3 shows a further exemplary embodiment of the transformer 1 according to the invention which, here, has means for thermal insulation 39 which are realized by insulating plates in the example shown. The thermally insulating plates 39 are fitted to the outside of the housing 6 of the transformer 1. Therefore, it is, for example, possible to run an alternating load operation even given arctic external temperatures since the idling losses now lead to heating up of the transformer, in the case of which the viscosity of the insulating liquid drops to values which allow circulation of said insulating liquid. The formation of dangerous local hotspots in the winding in the event of changes in load is avoided in this way. This is advantageous particularly in the case of transformers of which the housing 6 is filled with an insulating liquid 20 based on natural or synthetic esters since the viscosity of these fluids is considerably higher than in the case of insulating liquids 20 based on mineral oil. The rising branch 9 in the rising pipe 15 is arranged in such a way that circulation of the insulating liquid 20 of the device in the cooling element begins only when a temperature of the insulating liquid 20 which ensures reliable operation of the electrical device is reached.

Furthermore, a circuit for utilizing the lost heat of the transformer is illustrated in FIG. 3. Said circuit comprises a heat exchanger 17.1 which feeds a heating circuit for waste heat utilization 17.5. The inlet of the insulating liquid 20 is provided at a level which corresponds to a temperature at which meaningful utilization of the waste heat is possible. Furthermore, in an embodiment with waste heat utilization, the further cooling elements, by way of their upper fluid inlet, are arranged above the rising branch 9 for the cooling circuit with waste heat utilization. Therefore, effective utilization of the waste heat is possible without fittings which can be adjusted by motor since the circuit for waste heat utilization is preferably automatically supplied with warm cooling liquid. If the lost heat of the transformer 1 exceeds the quantity of heat required by the system for lost heat utilization or the waste heat utilization means is not in operation, this results in further heating of the insulating liquid and therefore in an increase in volume. Therefore, the insulating liquid 20 rises, so that further cooling elements are incorporated in the cooling operation. By virtue of suitably setting the diameter of the rising pipe 15 for supplying the cooling system 8, the temperature differences which lead to the incorporation of further cooling elements 10 can be precisely controlled. Therefore, a degree of control accuracy of less than 1 K is possible for the insulating liquid 20 given a correspondingly small diameter of the rising pipe 25.

Within the scope of the invention, the housing of the electrical device and the cooling system are filled with so much insulating liquid 20 that, at all temperatures in the temperature range already known, the housing is filled with the insulating liquid up to the bottom edge of a cover which closes the housing at the top and therefore the windings 4 and the lower parts of the bushings 7 are always surrounded by the insulating liquid.

The diameter of the rising pipe 15 is advantageously increased in size above the topmost rising branch, so that, in the event of a further rise in temperature, the cooling power no longer increases as the cooling area increases, but rather only as a function of the temperature difference in relation to the ambient temperature. This increase in size of the cross section of the rising pipe further serves to absorb a further increase in the volume of the insulating liquid which is caused by heating, since all of the cooling elements are already incorporated in the cooling circuit on account of the corresponding filling level of the insulating liquid being reached.

Figure 4:
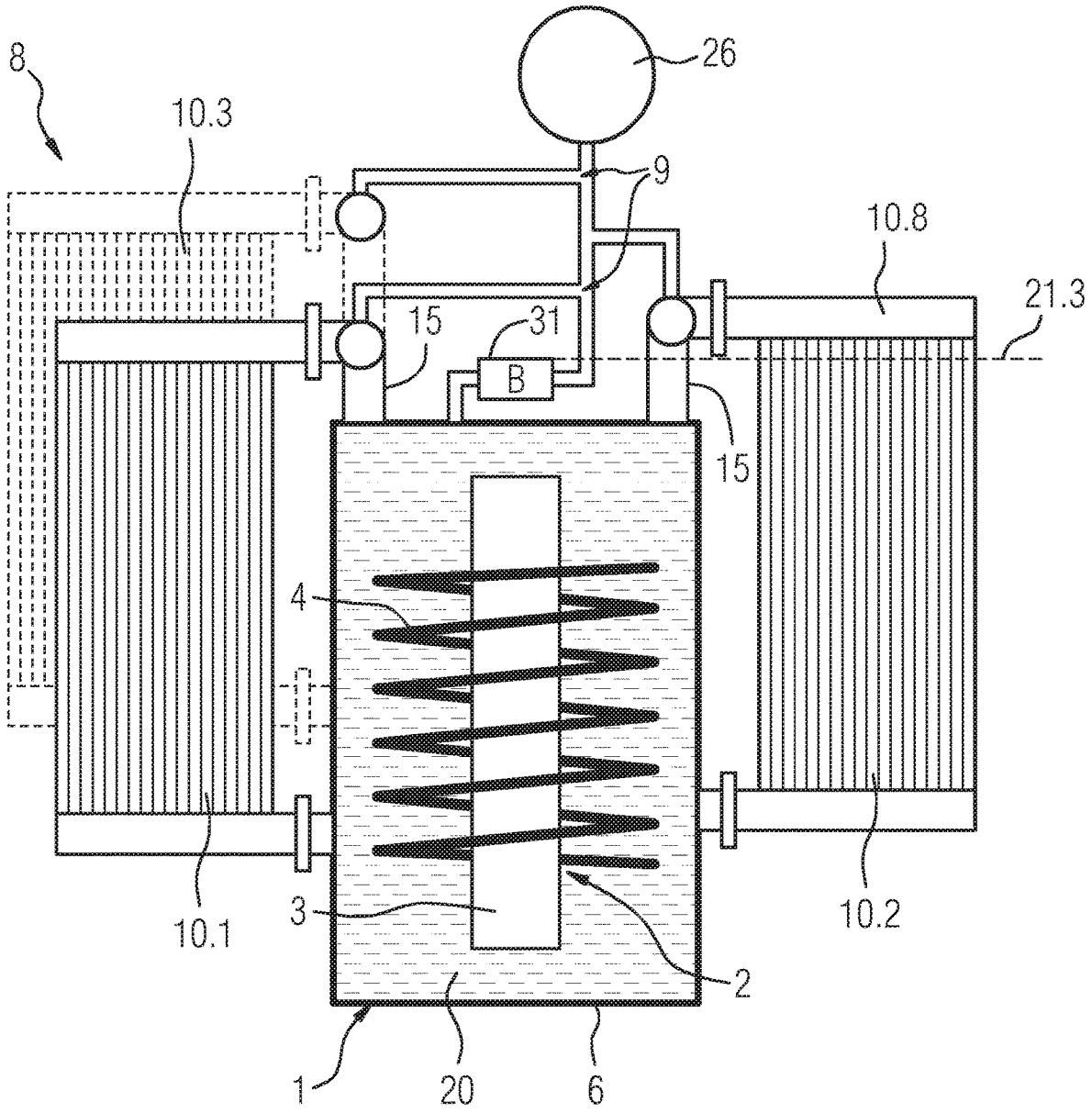

FIG. 4 shows an exemplary embodiment of the invention in which conventional radiators 10.1, 10.2, 10.3 are arranged on the transformer 1 in such a way that their upper manifold pipes 10.8 are arranged with a vertical offset. The transformer 1 has an expansion tank 26 of considerably reduced volume. Venting of the cooling system 8 is performed by means of pipelines to the expansion tank 26 which are arranged above a Buchholz relay 31.

In a further embodiment of the invention, at least some of the cooling elements 10 are arranged at the same height and are connected to the transformer 1 by means of a rising pipe 15 which is equipped with rising branches. The cooling elements 10 which are not filled with insulating liquid 20 at the respective filling level and also the supply line to the cooling system are compressible gas volumes and, given a corresponding design, can serve as burst-prevention means in the case of an inner short circuit of the transformer.

Figure 5:
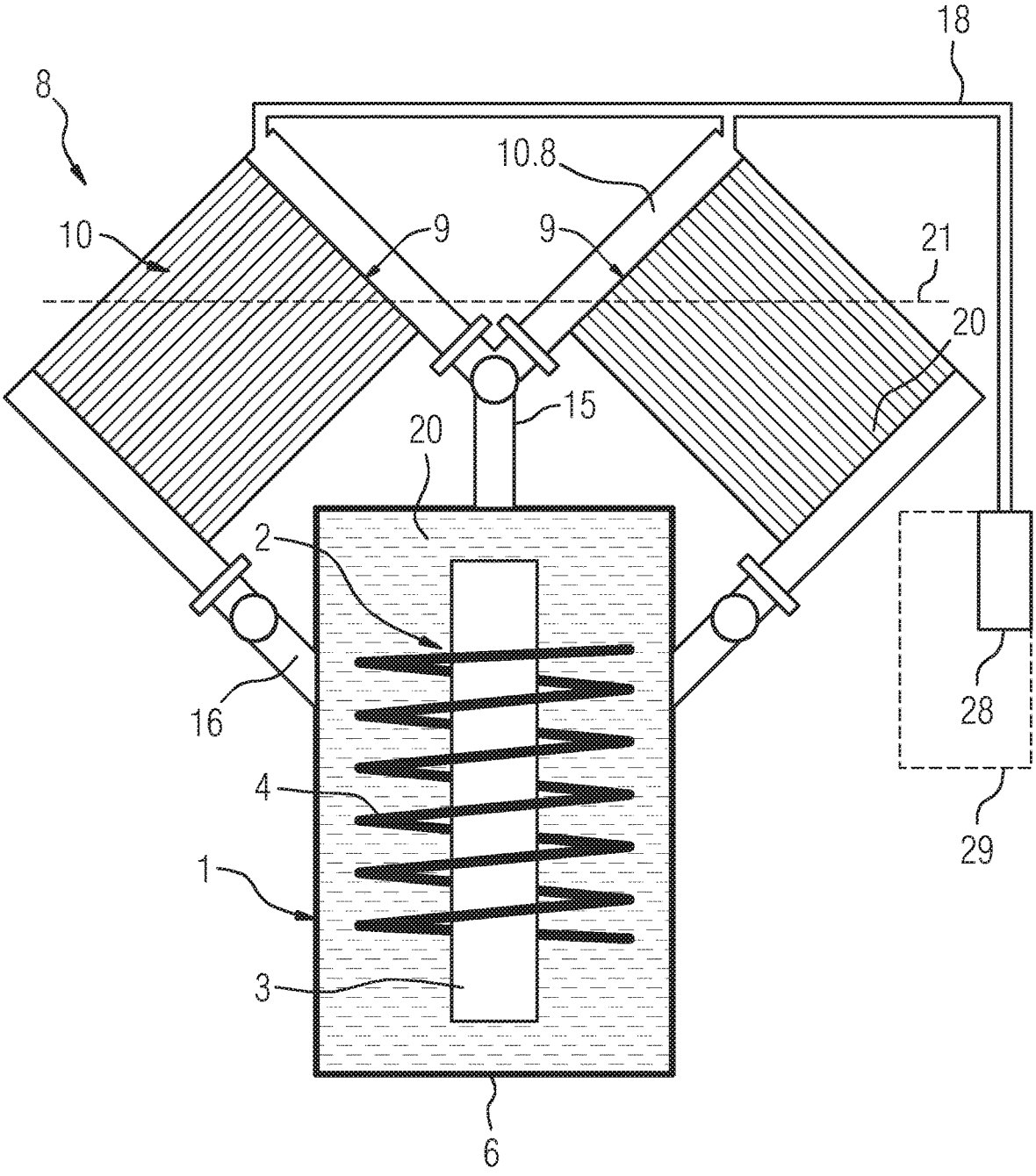

FIG. 5 shows a further exemplary embodiment in which matching of the cooling area to the temperature of the transformer 1 is achieved by inclined positioning of commercially available plates or pipe radiator 10. The inclined section 15.1 of the rising pipe 15 is provided with a venting connection at the upper end, situated opposite the input in the exemplary embodiment. The air which is displaced as the filling level rises is carried away by means of the pipeline 18 via this connection. The radiator 10 therefore both has a cooling effect and furthermore serves as an expansion tank of the transformer 1. The technical solution can be executed both as a breathing transformer 1 and also as a hermetically sealed transformer 1. In the case of the hermetic design, a gas compression chamber 29, which is illustrated in dashed lines in FIG. 5, is connected to the pipeline 18 instead of the air dehumidifying device 28. The space above the insulating liquid 20 is filled with an inert gas, preferably nitrogen.

Figure 6:
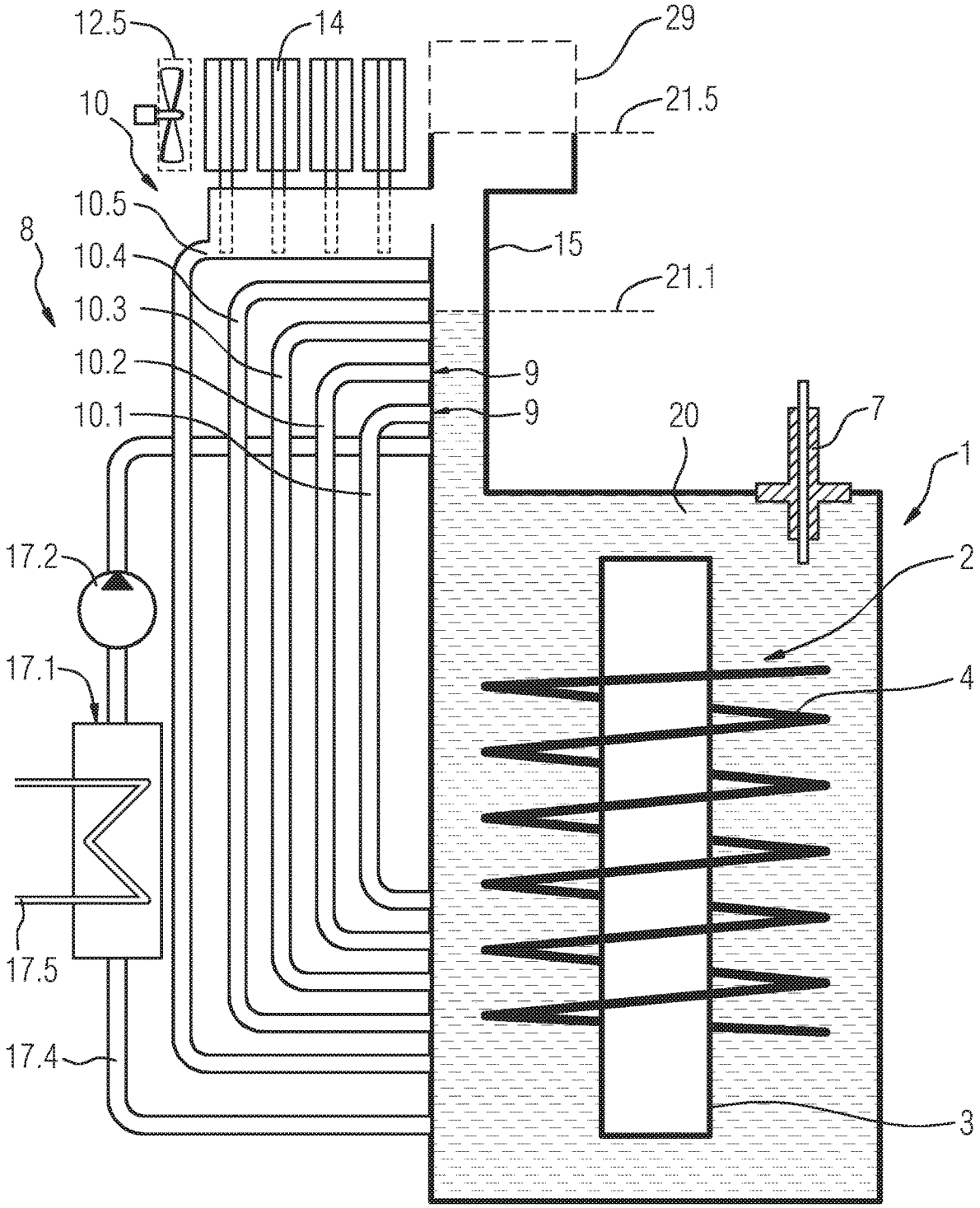

In the exemplary embodiment according to FIG. 6, the transformer 1 is additionally equipped with heat pipes 14. Said heat pipes are arranged in such a way that they deploy their cooling effect only when a specific filling level of the insulating liquid 20 is reached. The heat pipes 14 are designed for relatively high operating temperatures and lead to a considerable increase in the lost power which can be carried away. The heat pipes are, for example, a heat pipe or a thermosiphon which are known as such and manage without pumps or the like. In the exemplary embodiment, the heat pipes are configured as thermosiphon 14. In this case, a condensation section of the thermosiphon 14 is provided with additional cooling areas. In a special refinement, it is possible for air to additionally be blown onto the condensation section of the heat pipe 14 by a fan 12.5. Furthermore, the transformer 1 in the exemplary embodiment is of hermetically sealed design. To this end, the rising pipe 15 is enhanced with a gas compression chamber 29 above the maximum filling level 24.

LIST OF REFERENCE SYMBOLS

1 Electrical device
2 Active part

3 Core
4 Winding
6 Housing
7 High-voltage bushing
8 Cooling system
9 Rising branch
10 Cooling element
10.1 . . . 10.5 Cooling elements 1, 2, 3, 4, 5
10.8 Upper manifold pipe of the cooling device (in the case of a radiator)
12 Fan
14 Heat pipe
15 Rising tube
16 Return line
17.1 Heat exchange system
17.2 Pump
17.5 Heating circuit for waste heat utilization
18 Pipeline
19 Pipeline
20 Insulating liquid
21 Insulating liquid level
21.1 Insulating liquid level during normal operation
21.3 Minimum insulating liquid level
21.5 Maximum insulating liquid level
24 Region above the insulating liquid level
26 Oil expansion tank
28 Air dehumidifying device
29 Pressure compensation vessel
31 Buchholz relay
33 Temperature sensor
34 Filling level sensor
36 Pressure sensor
39 Thermally insulating plates

The invention claimed is:

1. An electrical device, comprising:

a housing;

an active part disposed in said housing, said active part being subject to high voltage and generating heat when operated;

an insulating liquid for cooling filled in said housing; and a cooling system for cooling said insulating liquid, said cooling system having a rising section connected to said housing for carrying said insulating liquid, said rising section being formed with a plurality of rising branches and having a respective cooling element connected at each said rising branch, said cooling elements being thermally conductively connected to an ambient atmosphere;

wherein a volume of said rising section is selected in dependence on a coefficient of thermal expansion of said insulating liquid such that a filling level reaches a different number of said rising branches at prespecified temperatures.

2. The electrical device according to claim 1, wherein said rising section has at least one inclined section which runs in an inclined manner in relation to a side wall of said housing, and wherein said rising branches are arranged in said inclined section.

3. The electrical device according to claim 2, wherein each said cooling element is a radiator which has a plurality of inner cooling channels.

4. The electrical device according to claim 2, wherein each rising branch is connected to a separate cooling pipe.

5. The electrical device according to claim 1, wherein said rising section has a vertical pipe section that extends said housing in a direction of a side that is averted from a base wall, and wherein said rising branches are arranged in said vertical pipe section.

6. The electrical device according to claim 5, wherein said cooling element is a pipe cooling means having an output connected to a base region of said housing, and wherein each said rising branch is connected to an input of said tubular pipe cooling means.

7. The electrical device according to claim 6, comprising a heat exchanger having an output connected to a base region of said housing, and wherein at least one rising branch is connected to an input of a pipeline which leads to said heat exchanger.

8. The electrical device according to claim 7, wherein said rising branch of said pipeline which leads to the input of said heat exchanger is arranged beneath at least one further rising branch for a further said cooling element.

9. The electrical device according to claim 1, wherein said housing, the cooling elements and said rising section form a pressure-resistant, hermetically sealed unit, and a space above the filling level of said insulating liquid is filled with a compressible inert gas.

10. The electrical device according to claim 1, wherein said rising section is formed with an opening above a maximum filling level of said insulating liquid, wherein a gas exchange with a surrounding area or further vessels is possible through said opening in an event of changes in volume which are caused by changes in a temperature of said insulating liquid, and wherein an interior of said cooling elements entirely or partially absorbs the fluctuations in the volume of said insulating liquid.

11. The electrical device according to claim 1, wherein a rising branch is connected to a heat pipe.

12. The electrical device according to claim 1, further comprising a fan for intensifying a cooling effect of said cooling system.

13. The electrical device according to claim 12, further comprising a filling level sensor, wherein said fan has a regulating device which is connected to said filling level sensor.

14. The electrical device according to claim 1, wherein said cooling elements are arranged with a vertical offset from one another.

15. The electrical device according to claim 1, wherein said electrical device is a transformer or an inductor coil.

* * * * *